US006213268B1

(12) United States Patent
Dancyger

(10) Patent No.: US 6,213,268 B1
(45) Date of Patent: Apr. 10, 2001

(54) UTILITY BAG

(76) Inventor: Michael Dancyger, 811 W. 58th St., Los Angeles, CA (US) 90064

( * ) Notice: Subject to any disclaimer, the term of this patent is extended or adjusted under 35 U.S.C. 154(b) by 0 days.

(21) Appl. No.: 09/418,208

(22) Filed: Oct. 13, 1999

(51) Int. Cl.[7] ..... A45C 5/12; A45C 13/02; A45C 13/36

(52) U.S. Cl. ..... 190/110; 190/112; 190/127; 150/113; 150/117

(58) Field of Search ..... 150/106, 109, 150/110–112, 114, 903, 113, 117; 206/373, 581; 383/4

(56) References Cited

U.S. PATENT DOCUMENTS

| | | | | |
|---|---|---|---|---|
| 285,305 | * | 9/1883 | Peirson | 190/110 X |
| 1,341,099 | * | 5/1920 | Abramson | 190/103 |
| 1,405,422 | * | 2/1922 | Kennedy | 206/373 X |
| 1,541,256 | * | 6/1925 | Frazer | 190/114 X |
| 1,984,345 | * | 12/1934 | Kennedy | 206/373 X |
| 2,845,973 | * | 8/1958 | Strong | 150/117 X |
| 2,904,091 | * | 9/1959 | Reed | 150/117 |
| 2,937,680 | * | 5/1960 | Dumas | 190/110 X |
| 4,773,515 | * | 9/1988 | Kotkins, Jr. | 190/103 |
| 5,114,007 | * | 5/1992 | Chen | 206/373 |
| 5,588,529 | * | 12/1996 | Speck | 190/110 X |
| 5,873,504 | * | 2/1999 | Farmer | 190/110 X |

* cited by examiner

*Primary Examiner*—Sue A. Weaver
(74) *Attorney, Agent, or Firm*—Andra M. Vaccaro

(57) ABSTRACT

The present invention provides a utility bag for carrying small and minute items and larger items such as medium size tools and the like from place to place in safety. The bag has a generally rectangular first compartment with has an opening therein and contains at least one removable tray and a second substantially pocketbook shaped compartment. A plurality of pockets are attached to the outside perimeter of the first compartment, except for the wall containing the opening. Using the bag of the present invention, the user can carry tools of various kinds and sizes and the like in the second compartment and in the pockets surrounding the first compartment and small/minute items in the tray located within the first compartment.

17 Claims, 3 Drawing Sheets

UTILITY BAG

FIELD OF THE INVENTION

The present invention relates generally to utility bags and specifically to soft-sided utility bags which are used by tradesmen, construction workers, handymen, plumbers, carpenters, fly fisherman and by anyone else who has the need to carry from place to place and thereafter have easy access to a plurality of numerous small and medium size items.

DESCRIPTION OF RELATED ART

There are currently in use many different types of carrying packs or bags used by various tradespersons, fly fisherman and the like who have a need to carry small items from place to place. Common examples include tool belts, bucket carriers, utility bags, and backpacks, all of which have numerous compartments or pockets for containing and carrying items of various sizes and shapes. However, each of the prior art devices has drawbacks for persons who deal with numerous small items to which they need access at the site, since the numerous small items tend to become lost or buried within the pockets or compartments. Further, the person seeking the items is required to search through the pockets or compartments until the correct item is found. The prior art devices also provide little protection or security for the tools themselves, and little or no compartmentalization for certain small materials or other items.

Thus, it would be desirable to have a bag that would provide easy access to any one of the numerous items contained therein. Further it also would be desirable if such a bag provided the user with a case that could contain numerous small and minute items without concern that they would be mixed together while being carried from place to place.

Certain prior art utility bags have hinged end enclosures which opens in doorlike fashion to give access to the interior of the bag such as the one that is disclosed in U.S. Pat. No. 4,752,008. In that prior art device, the only means of access to the items contained anywhere within the bag is through the hinged end enclosure.

Likewise, most travel or storage systems used by fly-fishermen comprise hard-case fly-tying boxes (or an adapted hard-case fishing tackle box of conventional design) or one of the other prior art carriers set forth above. The hard-case fly tying box utilizes a system of drawers with individually divided sections and a larger top-loading drawer for miscellaneous storage. Usually these cases are made of hard plastic and have several inherent drawbacks—materials and tools are not equally and easily visible and accessible at all times and the overall size and weight of the case makes it difficult to carry.

Thus, none of the prior art carrying devices provide for the ease of removal of a combination of types of articles by the user, nor do they provide a means of removing various small items contained therein without having to remove other larger items to gain access to the smaller items. Likewise, none of the prior art devices provide a separate compartment for just the small and minute items so that they may be carrier to place to place without mixing.

The present invention provides a simple device for carrying small and minute items and larger items such as medium size tools and the like from place to place, while allowing ease of access to any of the small and minute items as needed. The device of the present invention eliminates the need to stack various items on top of one another, which may require the removal of several of them from the device in order to get to the case containing the small and minute items. Likewise, the present invention also provides a removable tray for holding the small and minute items separately. The tray easily may be removed from the device through a special opening in the bag. The tray also is maintained in a substantially horizontal position to ensure that one minute item does not combine with another minute item therein during transport.

SUMMARY OF THE INVENTION

The invention is a soft sided utility bag having a generally rectangular first compartment and a second substantially pocketbook shaped compartment. The first compartment is comprised of six generally rectangular walls: a pair of opposed vertical side walls, a pair of opposed vertical end walls, a top wall and a bottom wall. One of the first compartment vertical side walls provides access to the interior of the first compartment. In the preferred embodiment, the first compartment vertical side wall has a large opening which provides access to the first compartment. Inside the first compartment is at least one removable tray which has a plurality of individual compartments for storing small and minute items. In the preferred embodiment, the tray is rigid and has a lid which prevents the items in the tray from mixing and spilling when the tray is closed. Also in the preferred embodiment, the tray is approximately the same size as the bottom wall of the first compartment.

The second compartment is comprised of five generally rectangular walls, a pair of opposed vertical end walls, a bottom wall and a pair of opposed vertical side walls, which are capable of collapsing in on themselves. Handle means are also provided so that the bag of the present invention may be carried from place to place. In the preferred embodiment, a handle is permanently affixed to the exterior of each one of the vertical side walls of the second compartment. Also, in the preferred embodiment a rigid hinged frame is attached to the top of each of the vertical side and end walls of the second compartment to provide additional support.

In the preferred embodiment, a plurality of pockets are attached to the outside of end walls and one of the vertical side walls of the first compartment. Using the bag of the present invention, the user can carry tools of various kinds in the second compartment and in the pockets surrounding the first compartment and small/minute items in the tray located within the first compartment.

DESCRIPTION OF PREFERRED EMBODIMENTS

Figure 1:
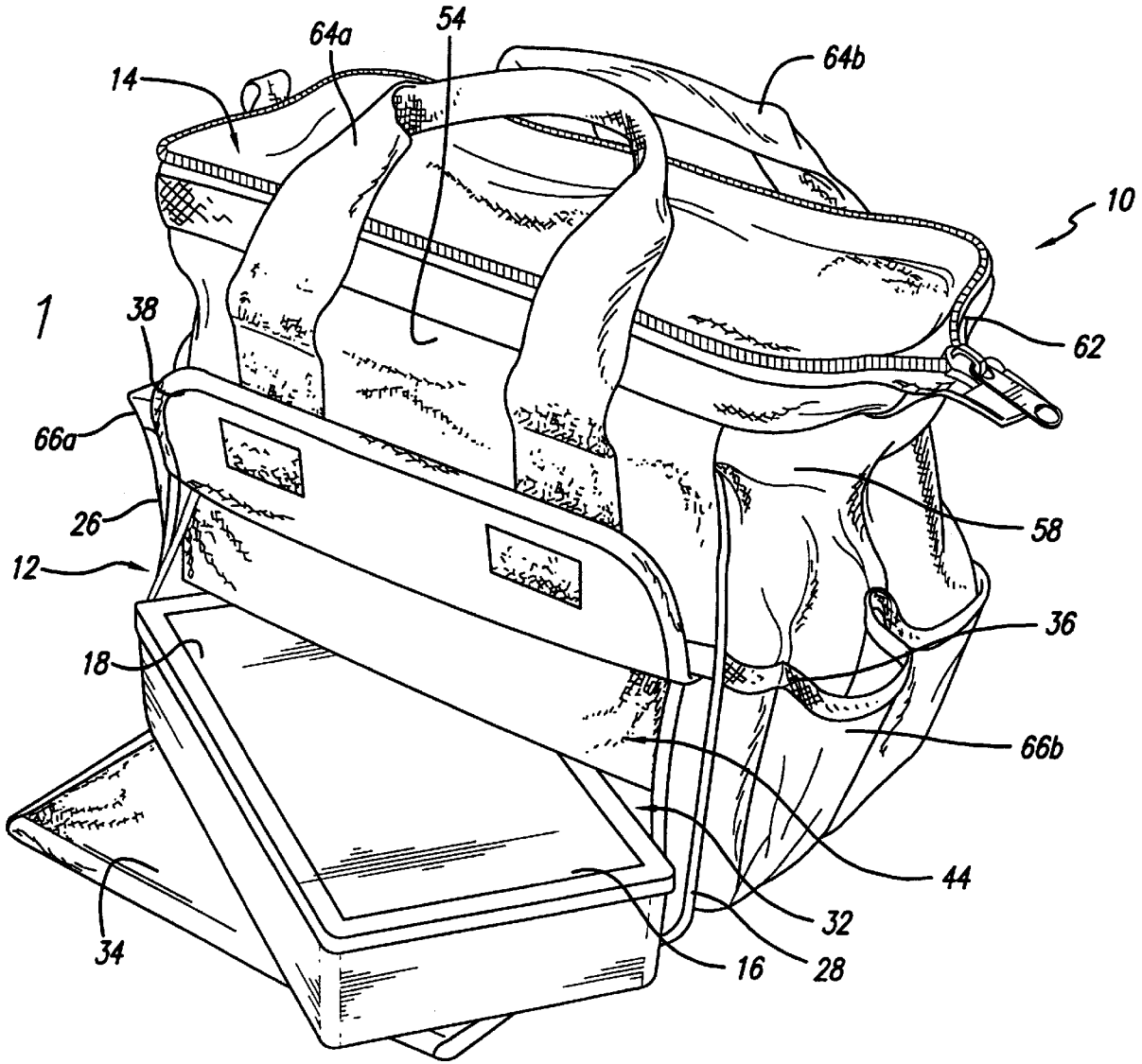
FIG. 1 is a perspective view of the top right side of the preferred embodiment of the present invention shown with the second compartment open and the first compartment open to expose a substantial portion of the removable tray located within the interior of the first compartment of the invention.
Figure 2:
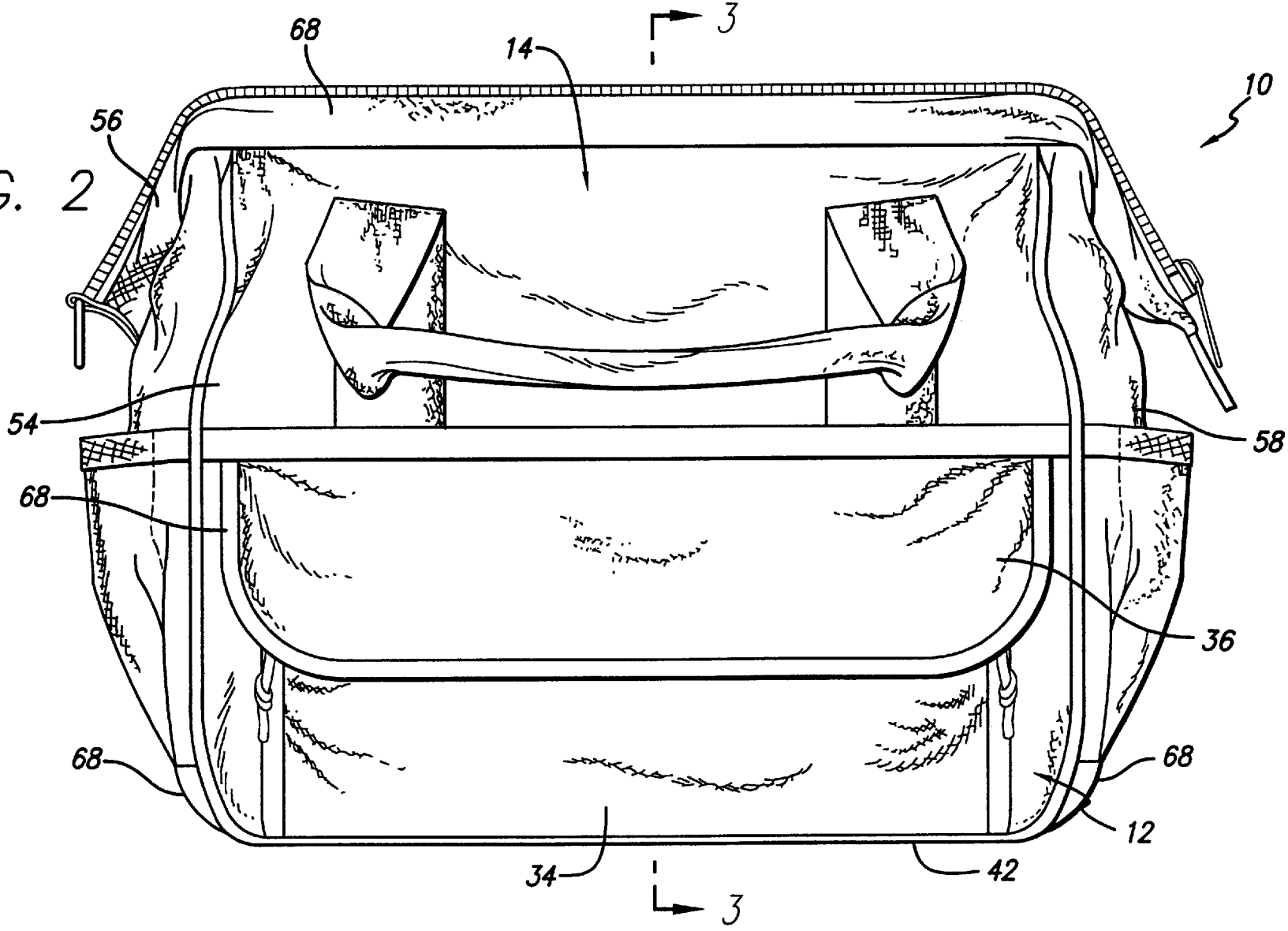
FIG. 2 is a plan view of the right side of the preferred embodiment of the present invention in which the first compartment is closed.
Figure 3:
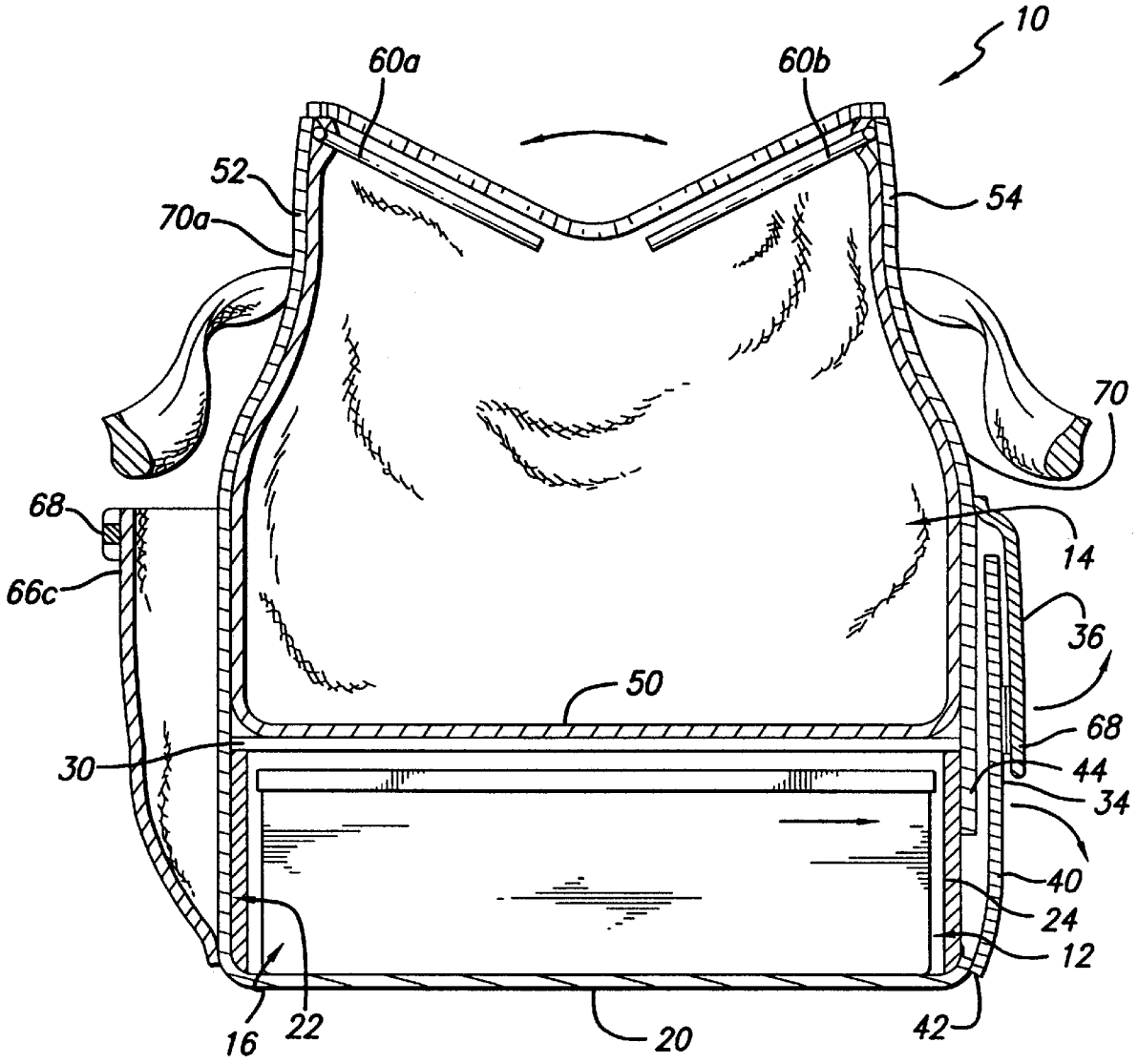
FIG. 3 is a cross-sectional view of the preferred embodiment of the present invention taken along lines 3—3 of FIG. 2, which illustrates the interior arrangement of the compartments and tray when the first compartment of the present invention is in a closed position.

Referring to the drawings, there is shown in FIGS. 1 through 3 the preferred embodiment of the present invention. In FIGS. 1–3, a carrying case 10 is shown which comprises a first compartment 12 and an second compartment 14. A removable tray 16 is located within first compartment 12. In the preferred embodiment tray 16 is comprised of a plurality of compartments (not shown) so that many small and minute items may be carried therein. Tray 16 also has a removable lid 18 thereon, which prevents the contents of the tray 16 from shifting, mixing or falling out during transport.

In lieu of one tray 16 being contained within first compartment 12, a plurality of smaller trays (not shown) may be carried within the first compartment 12.

First compartment 12 is comprised of 6 substantially rectangular walls: a first wall 20, pair of opposed vertical side walls 22 and 24, a pair of opposed vertical end walls 26 and 28 and a top wall 30. Each of the walls is attached to the adjacent two vertical walls and to the top and bottom walls 20 and 30 along corresponding parallel contiguous edges with reenforced edging.

The top, bottom and side walls 30, 20 and 22 may have a structural element (not shown) enclosed therein to maintain the structural integrity of the upper wall. These structural elements can be made of any suitable material, such as wood, metal, plastics or composites. In a typical embodiment, the structural elements are composed of metal wire or a rigid cardboard.

The first compartment vertical side wall 24 has an opening 32 which provides access to the interior of the first compartment 12 and to tray 16. In the preferred embodiment, opening 32 is created by a first flap 34 which has been cut out of wall 24 and attached to the remainder of wall 24 by a zipper. Alternatively, flap 34 could be completely detachable such that a zipper will be attached around the entire perimeter thereof so as to attach it to the first compartment when the tray is contained therein or flap 34 could comprise an entire side or end wall of the first compartment. The size and shape of the flap 34 is determined by the size of first compartment 16 and the size of the tray or other item that will be inserted into and carried within the first compartment 16. Flap 34 is attached to the bottom of the bag along the seam 42.

Also, in the preferred embodiment, first flap 34 is covered by a second flap 36, which is permanently affixed to the exterior of bag 10 such that it overlaps flap 34. Also in the preferred embodiment the inner surface 38 of flap 36 has hook or loop material thereon, while the outer surface 40 of the lower flap 34 has corresponding loop or hook material so that flap 36 may rest snugly against the top of flap 34. Alternatively, flap 36 could be attached to flap 34 by the use of a snap, clasp, hook or other similar attachment means.

In FIG. 1, the bag 10 is shown in an opened state, such that flap 36 has been lifted up and detached from flap 34, flap 34 has been unzipped around its side and top such that it lays flat, and tray 16 is partially withdrawn from the first compartment 12.

In FIGS. 2 and 3, the bag 10 is shown such that the first compartment 12 is in a closed state while the second compartment 14 is shown in an open state.

Second compartment 14 is comprised of 5 substantially rectangular walls: a bottom wall 50, pair of opposed vertical side walls 52 and 54, and a pair of opposed vertical end walls 56 and 58. In the preferred embodiment, second compartment 14 has a two part frame 60*a* and 60*b* integrated within the upper end thereof. The frame elements can be of any suitable material, such as wood, metal, plastics or composites. In a typical embodiment, the frame members 60*a* and 60*b* are composed of metal. Proximate the outer edge of frames 60*a* and 60*b*, a zipper 62 has been placed such that a user may fully enclose items within second compartment 14. Alternatively, a latch, clasp, snap, or other suitable enclosure means may be used instead of a zipper.

Second compartment can be configured a variety of ways, such that there is one large area, as shown in the preferred embodiment, or there could be a plurality of pockets, hooks, trays, etc. that could be placed on the inside thereof.

The bottom wall 50 of second compartment 14 may also enclose a piece of cardboard, foam or other suitable material to provide some additional support for the items to be carried within second compartment 14.

In the preferred embodiment, the second compartment 14 and the lower compartment 12 are enclosed within a protective shell 70*a* and 70*b*. However, the protective shell only extends part way down the vertical side wall 24 of first compartment 12 such that when flap 34 is undone, an optional structural element 44 is revealed which is created by the outer wall 70*b* of the bag 10.

The bag 10 is provided with handles 64*a* and 64*b* are permanently affixed to the shell 70*a* and 70*b* of the bag 10 to permit the bag 10 to be picked up and carried. In the embodiment illustrated in the drawings, handles 64*a* and 64*b* comprises two flexible straps. The ends of each strap 64*a* and 64*b* are attached spaced-apart near the side edges of the lower wall 50. The two handle straps 64*a* and 64*b* also could be attached together to form a single handle grip (not shown) by a flexible clasp (not shown). Handles 64*a* and 64*b* are attached to the bag by stitching or other suitable means. In the preferred embodiment, straps 64*a* and 64*b* are constructed of heavy duty nylon.

Also in the preferred embodiment, pockets may be attached around the perimeter of the bag 10. For example, as shown in FIGS. 1–3, pockets 66*a*, 66*b*, and 66*c* are attached to the outside of end walls 26 and 28 and to vertical side wall 22 of bag 10. While one row of pockets is shown, there may be partial or complete second and third rows of pockets permanently affixed, as well. Pockets 66*a*, 66*b*, and 66*c* are sized so as to accommodate elongated objects or varying weight and size.

In the first preferred embodiment, all of the edges of bag 10, including the edges of each flap, the immediate areas adjacent to the zipper 62 on the inside and the outside of bag 10, the upper and lower edges of each row of pockets, and the edges of upper flap 36 are reinforced with binding 68 to prevent fraying.

In the preferred embodiment, the bag 10 is made of a heavy duty lightweight material such as Cordura or a stiff canvas because of its relative rigidity, durability, light weight and ease with which it can be fastened together. However, if more flexible walls are desirable, the bag 10 can be made of any thin flexible material, such as cloth, flexible plastic or rubber.

Also additional compartments may be added to the bag 10 to provide additional storage and/or carrying areas for items.

While particular embodiments of the invention have been shown and illustrated herein, it will be understood that many changes, substitutions and modifications may be made by those persons skilled in the art. It will be appreciated from the above description of the presently preferred embodiment that other configurations and materials are possible and within the scope of the present invention. Thus, the present invention is not intended to be limited to the particular embodiments specifically discussed hereinabove.

What is claimed is:

1. A soft-sided utility bag for carrying small and minute items and larger items from place to place, while allowing ease of access to any of the items as needed, comprising:

a first compartment having an interior defined by fixed ton and bottom walls and at least one outer substantially vertical wall having a closable opening therein through which said interior of said first compartment is easily accessed;

a second compartment having an interior defined by a fixed bottom and at least one outer substantially vertical side wall, wherein said interior of said second compartment is accessed through the top thereof;

a fully removable non-integrated lidded tray comprised of at least one area for carrying small items, said tray comprising a shape that will allow it to fit within the opening of and be fully enclosed in at least one of said compartments, whereby when the tray is enclosed within said first compartment, it may be easily accessed through said opening without disturbing any contents that may be in said second compartment.

2. The soft-sided bag of claim 1, wherein said vertical side wall of said first compartments comprises four vertical generally rectangular walls: a pair of opposed side walls, a pair of opposed end walls, wherein at least one of said walls has said opening therein through which access is gained to the interior of said first compartment.

3. The soft-sided bag of claim 1, wherein said side wall of said second compartments comprises four substantially vertical rectangular walls: a pair of opposed side walls, a pair of opposed end walls, wherein the bottom of each wall is fixedly attached to said fixed bottom of said second compartment and the tops of each wall comprising said top opening through which access is gained into said compartment.

4. The soft-sided bag of claim 3 wherein said compartment further comprises closing means attached to the top of said vertical walls so as to be able to close said top opening.

5. The soft-sided bag of claim 1 further comprising structural means for supporting the bottom of said second compartment so as to minimize its deformity when items are placed thereon.

6. The soft-sided bag of claim 5, wherein said second compartment is placed directly above said first compartment such that said bottom wall of said second compartment is directly above at least a part of said top wall of said first compartment and said supporting means is directly under said bottom wall of said second compartment.

7. The soft-sided bag of claim 5, wherein said supporting means comprises at least one substantially rigid structural element.

8. The soft-sided bag of claim 5 wherein said supporting means is located within first compartment, such that it surrounds said tray.

9. The soft-sided bag of claim 1 further comprising a plurality of pockets affixed to at least one vertical wall along the outside perimeter thereof.

10. The soft-sided bag of claim 1, wherein said non-integrated removable tray comprises a plurality of compartments, and a lid, whereby when items are placed within said plurality of compartments and the lid is closed, they will not become mixed.

11. The soft-sided bag of claim 1, wherein the opening in the first compartment comprises a substantially rigid fixed member which extends across a portion of said opening.

12. The soft-sided bag of claim 1 wherein said vertical wall of said first compartment containing the opening comprises a first member which is fixedly attached on the bottom thereof to said bottom wall of said first compartment and removably attached on at least two sides thereof so that it may be opened and folded down from said first compartment into substantially the same plane as the bottom of said compartment to create said opening.

13. The soft-sided bag of claim 12, wherein the sides of said first member are removably attached to said first compartment.

14. The soft-sided bag of claim 1 wherein said vertical wall containing the opening comprises a first and a second member, said first member fixedly attached to said bottom wall of said first compartment such that it may be folded down into substantially the same plane as said bottom wall as well as being capable of being folded upward toward said second member and wherein said second member is fixedly attached to said top of said first compartment in substantially the same plane as the top wall thereof and being capable of being folded downward to cover at least a portion of said first member, and whereby said second member may be removably attached to said first member to form an enclosure.

15. A soft-sided utility bag, comprising:

a generally rectangular first compartment comprised of two horizontal walls: a top wall and a bottom wall, and four generally rectangular vertical walls: a pair of opposed side walls and a pair of opposed end walls; wherein at least one of said vertical side walls has a closeable opening therein to provide access to the interior of the first compartment;

a second compartment comprised of a substantially horizontal bottom wall and four generally rectangular substantially vertical walls: a pair of opposed end walls and a pair of opposed side walls, wherein the upper edges of said walls comprise an opening through which access is gained to said second compartment; said second compartment being located directly above at least a portion of said first compartment;

supporting means for supporting the bottom of said second compartment; and at least one removable tray which has a plurality of individual compartments for storing small and minute items which can be contained fully within a closed first compartment.

16. The soft-sided bag of claim 15 further comprising a plurality of pockets which are attached to the outside of said end walls and to the non-opening vertical side wall of said first compartment.

17. In a soft-sided utility bag containing an upper compartment and a lower compartment having vertical and horizontal sides, the improvement comprises:

a removable lidded tray having a plurality of compartments for storing various types of items, which is stored within the lower compartment, an opening in one of the vertical sides of the lower compartment through which the tray is accessed, a flap fixedly attached to at least one of the horizontal walls of the lower compartment and removably attached to the other vertical walls thereof, such that when said flap is attached to the other vertical walls, it covers said opening while said tray is inside of said compartment, and support means for supporting the bottom of the upper compartment.

* * * * *